US012225929B2

(12) United States Patent
Elmy

(10) Patent No.: US 12,225,929 B2
(45) Date of Patent: Feb. 18, 2025

(54) ELONGATED SMOKING ARTICLE

(71) Applicant: IMPERIAL TOBACCO VENTURES LIMITED, Bristol (GB)

(72) Inventor: Mido Elmy, Hamburg (DE)

(73) Assignee: IMPERIAL TOBACCO VENTURES LIMITED, Bristol (GB)

( * ) Notice: Subject to any disclaimer, the term of this patent is extended or adjusted under 35 U.S.C. 154(b) by 684 days.

(21) Appl. No.: 17/427,071

(22) PCT Filed: Jan. 29, 2020

(86) PCT No.: PCT/EP2020/052077
§ 371 (c)(1),
(2) Date: Jul. 29, 2021

(87) PCT Pub. No.: WO2020/157084
PCT Pub. Date: Aug. 6, 2020

(65) Prior Publication Data

US 2022/0095672 A1 Mar. 31, 2022

(30) Foreign Application Priority Data

Feb. 1, 2019 (EP) ..... 19155030

(51) Int. Cl.
*A24D 3/04* (2006.01)
*A24D 1/20* (2020.01)
(Continued)

(52) U.S. Cl.
CPC ..... *A24D 3/048* (2013.01); *A24D 1/20* (2020.01); *A24D 3/067* (2013.01); *A24D 3/16* (2013.01)

(58) Field of Classification Search
CPC ..... A24D 3/048
See application file for complete search history.

(56) References Cited

U.S. PATENT DOCUMENTS

2010/0108084 A1* 5/2010 Norman ..... A24D 3/048 131/338
2011/0180088 A1* 7/2011 Hooper ..... A24D 1/02 131/365
2021/0022390 A1* 1/2021 England ..... A24D 1/02

FOREIGN PATENT DOCUMENTS

RU 94 815 U1 3/2010
WO WO 2015/000974 A1 1/2015
(Continued)

OTHER PUBLICATIONS

Notice of Allowance and Search Report dated Jan. 26, 2022, for corresponding Russian Patent Application No. 2021122687/03(047368), (10 pages).
(Continued)

*Primary Examiner* — Eric Yaary
(74) *Attorney, Agent, or Firm* — Womble Bond Dickinson (US) LLP

(57) ABSTRACT

The present invention relates to an elongated smoking article (100) that extends in a longitudinal direction (L). The elongated smoking article (100) comprises a heatable tobacco material (11) and a filter element (20) aligned with the smoking body (10). The filter element (20) has at least one filter portion (30) and at least one hollow section (40), wherein the at least one hollow section (40) is disposed between the smoking body (10) and at least one of the at least one filer portion (30). The filter element (20) is sheathed by a tipping paper (50) together with the smoking body (10). The filter portion (30) comprises a material for reducing unwanted substances from an aerosol and a hollow section (40) has a barrier layer (51) disposed on its inner surface (41) and a carrier layer (52) disposed on the barrier layer (51). The carrier layer (52) contains a volatile additive (80) and the barrier layer (51) is impermeable to the volatile additive (80). The present invention also refers to a hollow
(Continued)

section (40) for an elongated smoking article (100) of the invention, the hollow section (40) being spirally wound from a cardboard sheet material (42) comprising a barrier layer (51) disposed on its inner surface (41) and a carrier layer (52) disposed on the barrier layer (51), wherein a volatile additive (80) is contained in the carrier layer (52) and the barrier layer (51) is impermeable to the volatile additive (80).

14 Claims, 2 Drawing Sheets

(51) Int. Cl.
*A24D 3/06* (2006.01)
*A24D 3/16* (2006.01)

(56) References Cited

FOREIGN PATENT DOCUMENTS

WO WO 2016/092295 A1 6/2016
WO WO 2016/124780 A1 8/2016

OTHER PUBLICATIONS

International Search Report and Written Opinion of the International Searching Authority, mailed May 4, 2020, Corresponding to PCT/EP2020/052077, 12 pages.
Extended European Search Report of corresponding EP 19155030.0, Aug. 5, 2019, 6 pages.
Taiwanese Office Action for TW Patent Application 109103083 dated Dec. 26, 2023 (with English translation), 10 pages.

* cited by examiner

ELONGATED SMOKING ARTICLE

CROSS-REFERENCE TO RELATED APPLICATION(S)

This application is a U.S. National Phase Patent Application of PCT/EP2020/052077, filed Jan. 29, 2020, which claims priority to European patent application 19155030.0, filed on Feb. 1, 2019, the entire content of each of which is hereby incorporated by reference.

FIELD OF THE INVENTION

The present invention relates to an elongated smoking article comprising a smoking body filled with a heatable tobacco material and a filter element attached to the smoking body via at least one tipping paper. According to the present invention, the filter element comprises at least one filter material and at least one hollow section. A barrier layer is disposed on an inner surface of the hollow section and a carrier layer is disposed on the barrier layer. A volatile additive, such as e.g. nicotine or a flavoring, is loaded to the carrier layer.

BACKGROUND

Elongated smoking articles, such as e.g. (filter) cigarettes or cigarillos, are usually of cylindrical shape and comprise a smoking body that is filled with a combustible material. Therein, the combustible material comprises tobacco or a tobacco related product, such as e.g. shredded tobacco or reconstituted tobacco. Also, heating tobacco products are known, wherein a tobacco-related smoking body is heated rather than burned. In such heating tobacco products the smoking body is filled with a heatable tobacco-related material, usually comprising a tobacco component and an aerosol-forming component, such as e.g. glycerin or the like. For forming the smoking body of a conventional smoking article, the combustible material may be surrounded by a combustible wrapping paper. In a heating tobacco product the wrapping paper does not need to be combustible and might even be fire-retardant.

Usual smoking articles have a cylindrical filter element that is aligned with the smoking body. The filter element is configured to filter unwanted substances, e.g. tar, from the aerosol emitted by the burning or heated smoking body and might comprises cellulose acetate, paper, and/or charcoal. The filter element is usually attached to one end of the smoking body using a circumscribing wrapping material known as tipping paper. Therein, the tipping paper is overlaid with and attached to the filter element and the smoking body, as shown in FIG. 1.

It is further known from the art to incorporate flavoring materials into smoking articles. Therein, the flavoring has been traditionally applied directly to the tobacco in order to flavor the tobacco smoke that reaches the mouth of the smoker. It is further known from the prior art that this effect may be achieved by applying the flavoring to the wrapping paper or the filter element of an elongated smoking article. For delivering an improved gustatory experience directly to the mouth of a user it is further known to apply a flavoring material to an external surface of the filter element of a smoking article. However, in heated tobacco products the application of flavorings into the heatable tobacco-related material might not be satisfactory, as the smoking body is heated as a whole rather than being burned down from one end to the other. Highly volatile flavorings thus tend to be emitted in the very beginning of the smoking experience. Applying flavorings to the wrapping paper might also have no effect, as the wrapping paper is not burned down and might not even be heated sufficiently to vaporize the flavoring. Finally, adding a flavoring to the filter element inevitably confronts the user with the flavoring.

US 2018/0010786 A1 discloses an elongated smoking article extending in a longitudinal direction, wherein the hollow section is separated from the filter by multiple recesses to form so called transfer sections that enable a reduction of components, manufacturing costs and complexity and additionally improve structural rigidity.

It is thus an object of the present invention to provide a solution for adding a volatile additive to an elongated smoking article forming a heated tobacco product that is configured to be heated rather than being burned, the latter using a suitably configured heating device.

SUMMARY OF INVENTION

One or more of the drawbacks of the prior art could be avoided or at least reduced by means of the present invention, particularly by an elongated smoking article that extends in a longitudinal direction and comprises a cylindrical smoking body with a heatable tobacco material. Therein, the heatable tobacco material comprises a tobacco component, such as e.g. reconstituted tobacco, and an aerosol forming component, such as e.g. glycerin.

The elongated smoking article further comprises a cylindrical filter element that is aligned with the smoking body in the longitudinal direction thereof. At least one paper is circumscribing both, the smoking body and the filter element, and is configured for attaching the smoking body and the filter element. Therein, the at least one paper preferably extends from the filter element to the smoking body, i.e., across a junction between the filter element and the smoking body. Therein, the at least one paper may cover each of the smoking body and the filter element at least partially within the longitudinal direction of the elongated smoking article. According to a preferred embodiment, the at least one paper comprises a combining paper and/or a tipping paper. For the ease of description, in the following it is solely referred to tipping paper instead of the at least one paper, however without restricting or intending to restrict the scope of the present disclosure.

According to a preferred embodiment, the tipping paper solely covers parts of the filter element and the smoking body in the longitudinal direction thereof, respectively. Then, each of the filter element and the smoking body preferably comprise a wrapping paper forming a respective cylindrical surface around the filter element and the smoking body, respectively.

According to another preferred embodiment, the tipping paper extends along the whole length of the smoking body and the filter element. According to this preferred embodiment, the tipping paper preferably forms a cylindrical surface around the smoking body, wherein one base area of the smoking body and one base area of the filter element remain uncovered by the wrapping paper. The other both base areas of the smoking body and the filter element are facing each other. Thus, the filter element is attached to one of the base areas of the smoking body in an end-to-end relationship and elongates it.

The filter element preferably is also of cylindrical shape with the same cross section as the smoking body. The uncovered base area of the smoking body may be configured for inserting a heating element and the uncovered base area of the filter element is configured to be used by a consumer to draw an aerosol from the heated smoking body. The tipping paper circumferentially encloses the cross sections of the smoking body and the filter element and extends in the longitudinal direction across the smoking body and the filter element. The tipping paper might be further attached to external surfaces of both, the smoking body and the filter element for connecting the smoking body and the filter element.

The filter element has at least one filter portion and further has at least one hollow section, wherein these sections are also aligned along the longitudinal direction of the elongated smoking article. The at least one hollow section is disposed between the smoking body and at least one of the at least one filter portion. In other words, the hollow section(s) are disposed between the heatable tobacco material and at least one filter portion. However, the filter element may comprise additional elements, such as e.g. a mouthpiece, and an additional filter portion may also be arranged between the hollow section and the smoking body. Further preferred, the at least one filter portion and the at least one hollow section are of cylindrical shape with essentially the same cross section as each other and the smoking body. The at least one filter portion is configured to reduce unwanted substances from an aerosol that is emitted from the heated smoking body and that is drawn by a user via the uncovered base area of the filter element through the filter element as a whole. On an inner surface of at least one of the at least one hollow section a barrier layer is disposed, wherein the barrier layer may be disposed directly on the inner surface, e.g., by being coated thereon, or via another layer, e.g., by being adhered thereon via an adhesive layer. A carrier layer is disposed on the barrier layer, particularly on an inner surface of the barrier layer. Therein the carrier layer may be disposed directly on the inner surface, e.g., by being coated thereon, or via another layer, e.g., by being adhered to the barrier layer via an adhesive layer.

According to the present invention, a volatile additive is loaded to the carrier layer. In other words, the material of the carrier layer contains the volatile additive. Therein, the volatile additive is preferably configured to release, upon interaction with the aerosol emitted by the heated smoking body and drawn through the filter element, at least one substance. The substance is thus emitted into the aerosol and increases the concentration of at least one preferred substance within the aerosol. The volatile additive might comprise a flavoring which can thus be provided to a user during the whole smoking experience. According to the present invention, the barrier layer is further configured to prevent migration of the volatile additive towards an exterior of the filter cigarette, particularly towards an exterior of the hollow tube. Preferably, the barrier layer is at least semi-permeable for the volatile additive, preferably less than semi-permeable and particularly preferred impermeable for the volatile additive. In other words, the barrier layer is configured to prevent the volatile additive to pass through the hollow section as well as into the tipping paper. If a cardboard hollow cylinder is used, the barrier element is preferably configured to prevent the volatile additive to migrate into the cardboard and more preferred towards the cardboard.

Advantageously, the barrier layer thus prevents that the volatile additive is used of prior to the smoking experience, e.g., due to high ambient temperatures, as it prevents or at least impedes the volatile additive from leaving the elongated smoking article. Further, the barrier layer prevents the volatile additive to penetrate through the at least one hollow section to an outer side thereof. Thus, an unpleasant appearance of the elongated smoking article, e.g., with a wrapping paper stained from the volatile additive, can be fully prevented. Further, using the hollow tube for adding the volatile additive advantageously provides more surface area for depositing a volatile additive, e.g., comprising at least one flavoring. However, the filter cigarette may comprise additional flavoring, e.g., in the tobacco, on or in the filter element, such as e.g., in the filter material, on or in the at least one (wrapping) paper etc.

In a preferred embodiment of the elongated smoking article according to the invention, the at least one hollow section comprises a hollow cylinder that is spirally wound from a sheet material. Therein, the spirally wound sheet material partially overlaps and overlapping parts are attached, e.g., adhered, to each other. Thus a hollow cylinder can be easily provided that functions as a support structure for the filter element. The hollow cylinder further provides that the aerosol drawn from the heated smoking body is sufficiently mixed before it reaches the user. Hence, a uniform aerosol and taste experience can be provided to the user. In contrast thereto, the filter element does not need to be completely filled with filter material as such complete filling might rather impede drawing the aerosol from the smoking body. It was found that a volatile additive on an inner surface of such hollow cylinder is added significantly to a hot aerosol passing through the hollow cylinder. Further, providing such hollow cylinder by a spirally wound sheet material is a simple and material-efficient way for manufacturing such hollow section. Particularly preferred, the hollow cylinder is made from spirally wound cardboard material. Hollow cardboard cylinders made of spirally wound cardboard sheet are known from the prior art.

The preferred embodiment using a hollow cylinder from spirally wound sheet material for making the hollow section further allows attaching the barrier layer and the carrier layer to the unwound, i.e., not wound yet, sheet material. Thus, an easier process is provided compared to introducing the barrier material and the carrier layer into a bore of an already formed hollow cylinder section. Preferably, the barrier layer, i.e., the material of the barrier layer (barrier material), is deposited on one surface of the unwound sheet material, wherein the one surface is to become the inner surface of the wound sheet material. Then, the carrier layer, i.e., the material of the carrier layer (carrier material), is deposited on the barrier layer (barrier material). Either a barrier layer and/or a carrier layer as a whole may be attached to the unwound sheet material or a barrier material and/or a carrier material may be deposited on the unwound sheet material for forming the respective layers directly on the sheet material. Preferably, at least one of the barrier layer and the carrier layer is provided as a coating of the sheet material or the carrier layer, respectively, wherein the coating may be provided in a liquid form and then be dried and/or cured on the surface of the sheet material.

In a particularly preferred embodiment, the barrier layer and the carrier layer are formed as a laminate. Preferably, the barrier layer and the carrier layer are attached to the unwound sheet material in the form of a laminate, i.e., the carrier layer and the barrier layer are attached to each other before they are attached to the unwound sheet material. Particularly preferred, the laminate of the barrier layer and the carrier layer is an aluminum-paper-laminate with the aluminum layer being the barrier layer and the carrier layer being the paper layer. Such laminate materials are already used in packaging of smoking-related articles, e.g., as inner line of a cigarette packaging, and are thus easily available to manufacturers of smoking-related articles. However, the barrier layer preferably is an aluminum layer and the carrier layer preferably is a paper layer without these layers forming a laminate. Also other materials can be used for the barrier layer and the carrier layer, respectively. The barrier layer preferably comprises a metal or a plastic material, wherein a layer of this plastic or metal material is preferably impermeable to the used volatile additive. The carrier layer preferably comprises a fibrous material that is sufficiently bibulous for the volatile additive and is suitable for releasing the volatile additive to a passing hot aerosol.

Further preferred, the heatable tobacco material is configured to emit a tobacco-flavored aerosol when being heated to a temperature between 100° C. and 400° C., which is far below a combustion point of the heatable tobacco material. Further preferred, an aerosol-forming substrate may be adsorbed, coated, impregnated or otherwise loaded to the heatable tobacco material. The heatable tobacco material preferably comprises nicotine and further preferred comprises tobacco. Exemplarily, the heatable tobacco material may comprise volatile tobacco flavor compounds, which are released upon heating. However, the heatable tobacco material does not necessarily comprise tobacco. The smoking body, particularly the heatable tobacco material of the smoking body, is preferably configured to interact with an electronic smoking device for generating an aerosol. In other words, the elongated smoking article constitutes one part of an aerosol-generating article and the electronic smoking device constitutes the other part of an aerosol-generating article. Therein, the electronic smoking device comprises means for heating the heatable tobacco material of the smoking body, e.g., electrical heating elements.

By the transfer of heat from the means for heating towards the heatable tobacco material an inhalable aerosol may be generated as volatile compounds are released from the heatable tobacco material and are entrained in air drawn through the filter element. As the released compounds cool, they condense to form an aerosol that can be inhaled by the consumer. In a further preferred embodiment, the cylindrical smoking body comprises a heat reflecting layer circumscribing the heatable tobacco material. In other words, the heat reflecting layer is disposed between the heatable tobacco material and the wrapping paper. The heat reflecting layer advantageously allows to more uniformly heating the heatable tobacco material with a heating element of the electronic smoking device inserted into the heatable tobacco material. Further preferred, the wrapping paper itself is configured to function as heat reflecting layer.

Further preferred, the at least one filter portion of the filter element comprises a cellulose acetate and triacetin. Further preferred, the filter element may comprise active coal. Further, the filter element may comprise one or more filter elements, wherein the filter elements may or may not be positioned such that the contact the consumer's lips. The filter element may thus also comprise one or more hollow sections, e.g. as one hollow section may be divided into parts by one or more filter portions disposed therein. The filter portions may be disposed between separate hollow sections or may be inserted into the hollow section. In the latter case, the hollow section may comprise the barrier layer and the carrier layer only in sections thereof that do not comprise filter portions or along the whole length of the hollow section. In other words, the hollow section may also extend along the whole length of the filter element.

In a preferred embodiment, the volatile additive that is disposed in the material of the carrier layer (carrier material) is applied in form of a solution of the volatile additive to the carrier material. More general, the volatile additive is applied as an at least initially not solid substance to the carrier. Preferably, the volatile additive is printed to the carrier material. Thus, the volatile additive may include or be included in a variety of substrates for application to the carrier material such as, for example, inks, films, or other compositions that may include one or more pigments, fillers, and/or optical brightening agents. In a preferred embodiment, the volatile additive composition is formulated to be printed on one or both sides of carrier material before, during, or after assembly of the elongated smoking article. However, the volatile additive formulation may also be applied by other means including, for example, misting, spraying, or soaking the tipping material. One or more volatile additive compositions may be incorporated into carrier material during their manufacture.

At least one layer of volatile additive and possibly several layers of one or more volatile additives is applied to a carrier material, preferably using a printing process. Most preferably, the volatile additive is applied using gravure coating techniques, such as e.g. rotogravure printing techniques. Other preferred techniques for the applying the volatile additive to the carrier material include blade coating, air-knife coating, roll-coating and shaft coating techniques. Alternatively and/or additionally, the volatile additive can be applied by spraying, ink jet coating, or other similar printing techniques. Gravure printing techniques involve printing from the continuous surface of a metal cylinder engraved mechanically or etched chemically so as to possess minute grooves or cells below the surface of that cylinder.

A typical printing cylinder surface is provided by etching a smooth, polished copper surface and plating that etched surface with chrome. Those recessed cells or grooves hold liquid (or liquid dispersion) formulations form impressions, layers or "bumps" to be deposited onto the desired location of a substrate, such as a continuous web of paper carrier material. Other printing techniques may be used as well, including flexographic, ink-jet, thermal-transfer (including laser), screen printing, or any other method for transferring a volatile additive composition to a paper or paper-like material used as a carrier material.

Different solvents may be selected to carry the volatile additive during application. Most solvents preferably will evaporate and/or will not have a negative impact upon the volatile additive (including a smoker's experience thereof). Preferably, the solvent will not disrupt or damage the structure of the carrier material, e.g., the carrier paper or the hollow tube (e.g., by weakening) or negatively affecting its appearance, nor will it confer any undesirable flavor.

Additionally or alternatively to the printing-type and other applications described herein, at least one volatile additive might be applied with an adhesive to the tipping material. Some examples of volatile additive, particularly flavorings, that may be printed or otherwise applied to the carrier material or an adhesive include methyl cyclopentenolone, vanillin, ethyl vanillin, inulin and aromatic oil. Other flavorings (including flavor and aroma precursors) include, for example, vanillin glucoside and/or ethyl vanillin glucoside. Other flavorings may include, for example, ethyl vanillin, caryophyllene oxide, sugars (e.g., rhamnose), and different flavor precursors that will produce a flavor and/or aroma when contacted by the lips or tongue of a smoker and/or heat and/or moisture from mainstream aerosol. Inks that are useful as flavorings provide a scent, aroma, or other olfactory sensation.

The volatile additive may be incorporated by means other than printing to one or both surfaces of the carrier material. For example, the carrier material may be dipped into a volatile additive such that it will be absorbed thereby and/or will adsorb to surfaces of material making up the carrier layer. As another example, microcapsules configured to release flavoring(s) may be incorporated into the carrier material, for example, upon contact with moisture and/or warmth of a heated aerosol. Examples of such capsules may comprise synthetic capsules and/or biologically-derived "capsules", such as e.g., yeast organisms as a delivery means. As set forth above, the volatile additive may also comprise nicotine.

In the context of this application, a flavoring is any substance that is capable of producing a gustatory sensation to a consumer, particularly when in contact with the lips or the tongue of a consumer. Preferably, the flavoring is further capable of providing an olfactory sensation to the consumer (smoker, user), which might be independent of the contact with the consumer's lips or tongue. Flavoring includes any material that may be applied to the carrier layer and that provides one or more of a selected organoleptic sensation, a sensation of one or more tastes/flavors and/or scents/aromas that may be transmitted orally and/or olfactory, trigeminal nerve stimulation sensation, and may include a cool, warm, spicy, tangy, salty, tingly, bitter, sour, hot, sweet, or tart sensation for a smoker, or any combination thereof.

In the context of this application, the volatile additive may provide a substance, e.g. nicotine, or a flavor by releasing the substance, e.g. an odor, whether passively, upon being heated by passage of, for example, an aerosol of the heated smoking body. Release of flavor-affecting material (whether by or to the mouth and/or nose of the smoker) can be activated or intensified by heating the volatile additive when a smoker draws the aerosol of the smoking body through the filter element such that this aerosol streams proximate to the flavoring.

Some preferred flavorings will exhibit sensory characteristics that can be described as having notes that are sweet, woody, fruity, or some combination thereof. The flavorings are preferably employed in amounts that depend upon their individual detection thresholds. Combinations of flavorings may be used to provide one or more desired sensory characteristics to the experience of a smoker from the smoking articles incorporating those flavorings. Above that, some flavorings will provide a unique sensation to a smoker that may include, but go beyond one or more of taste, smell, and tactile sensation. For example, such flavorings may include menthol, menthanes, menthones, sweet proteins (e.g., thaumatin, monellin), essential oils containing menthol or menthol-like compounds (e.g., peppermint), other essential oils (wintergreen, spearmint), succinate esters, capsaicin, cinnamon, or any commercially-available (or future-developed) "cooling compounds" or "spicy compounds".

Preferred flavorings may be incorporated into printing formulations, will have low vapor pressures, will not have a tendency to migrate or evaporate under normal ambient conditions, and will be stable under the processing conditions of the elongated smoking article according to the present invention. Exemplary flavorings that provide sweet notes include ethyl vanillin, vanillin, inulin (a fructose oligomer).

Another aspect of the present invention is directed to a hollow section for an elongated smoking article according to the present invention as described above. The hollow section of the present invention preferably is spirally wound from a cardboard sheet material and comprises a barrier layer that is disposed on its inner surface. Further preferred, the hollow section comprises a carrier layer that is disposed on the barrier layer. A volatile additive is contained in the carrier layer and the barrier layer is impermeable to the volatile additive. The preferred embodiments described above with respect to the elongated smoking article do also apply to the hollow section of the invention.

BRIEF DESCRIPTION OF DRAWINGS

Further features of the invention will become apparent to those of ordinary skill in the art by describing in detail exemplary embodiments with reference to the attached drawings in which.

DETAILED DESCRIPTION OF EXAMPLE EMBODIMENTS

Figure 1:
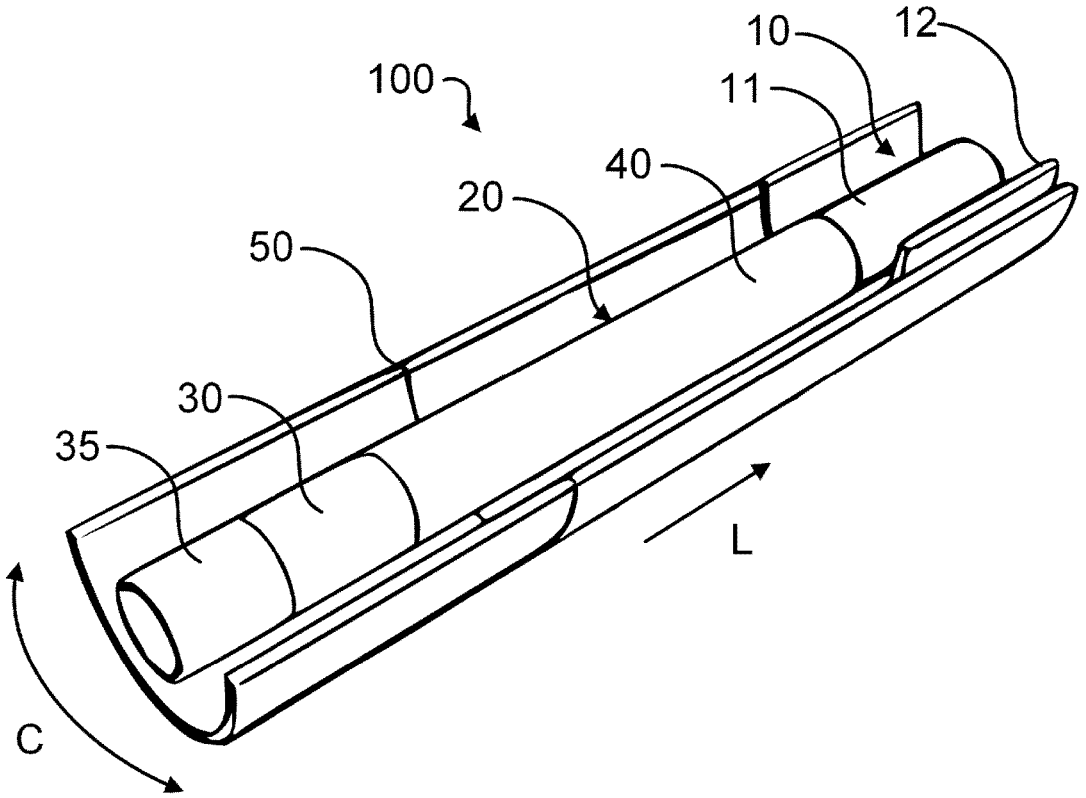
FIG. 1 illustrates a schematic perspective view of an elongated smoking article.
Figure 2:
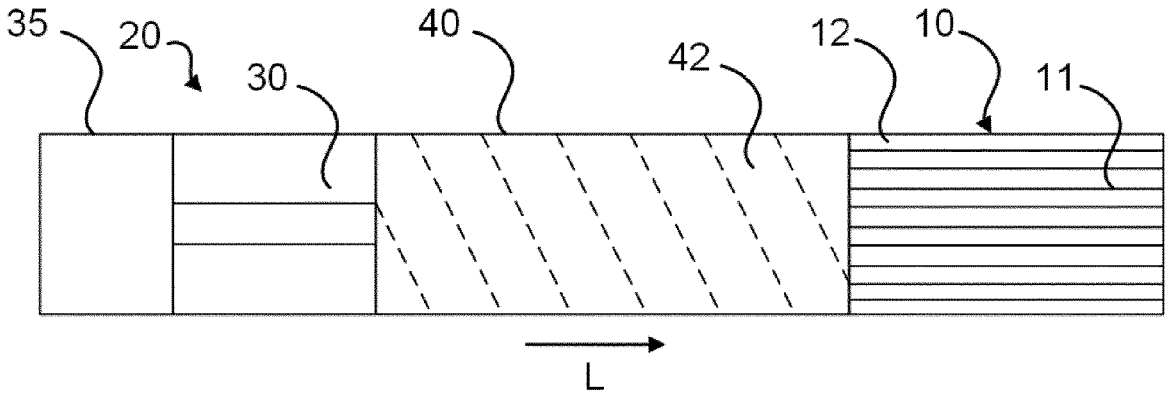
FIG. 2 illustrates a schematic cross section of a filter element of an elongated smoking article according to a first embodiment.

With reference to FIG. 1, a schematic perspective view of a smoking stick 100 as an example of an elongated smoking article 100 is shown and a schematic cross section of the smoking stick 100 is shown in FIG. 2. The smoking stick 100 includes a cylindrical rod of heatable tobacco material 11 that is loaded with glycerin as an additionally aerosol-forming component. The cylindrical surface of the tobacco material 11 is surrounded by a heat reflective layer 12, e.g., an aluminum layer for allowing a more uniformly heating thereof.

The tobacco material 11 within the heat reflective layer 12 is referred to as smoking body 10 and one base area of the smoking body 10 is open to expose the heatable material 11. At this open base area of the smoking body 10 the tobacco material 11 can be heated by inserting a heating element through this open base area (inside-out-heating). Alternatively, the tobacco material 11 can be heated by inserting the smoking stick 100 into a heating element (outside-in-heating). At the opposite base area of the smoking body a filter element 20 is positioned. The filter element 20 comprises a mouthpiece portion 35, a hollow section 40 and a filter portion 30, wherein the hollow section 40 is disposed between the smoking body and the filter portion 30. The mouthpiece portion 35 is arranged at a terminal end of the filter element 20 and forms an open base area of the elongated smoking article that allows a user to draw an aerosol from the heated tobacco material 11 for inhalation. The base areas of the filter element 20 and smoking body 10 permit the passage of an aerosol there through.

The filter element 20 and the smoking body 10 are axially aligned in an end-to-end relationship along a longitudinal relationship L of the smoking stick 10. The filter element 20 has a generally cylindrical shape with a diameter that is essentially equal to the diameter of the smoking body 10. The filter element 20 is fixed to the smoking body 10 via a tipping paper 50 that is circumscribing both, the filter element 20 and the smoking body 10. The tipping paper 50 is wrapped over the whole length of the filter element 20 and whole length of the smoking body 10 along the longitudinal direction L and might be attached by an adhesive to external surfaces of the smoking body 10 and the filter element 20 or to itself. Thus, the tipping paper 50 provides a force closure between smoking body 10 and filter element 20 via an indirect adhesive bond using a suitable adhesive, such as e.g., a water-based adhesive of the type traditionally employed by cigarette manufacturers for application of tipping paper during filtered cigarette manufacture.

The filter portion 30 includes a filter material, such as e.g. plasticized cellulose acetate treated with triacetin, which is configured to reduce unwanted substances in an aerosol that is drawn by a smoker from the heated smoking body 10 through the filter element 20. The filter portion 30 is provided as a donut filter having a hollow cylinder of aforementioned materials and a hollow bore for allowing a user to easy draw an aerosol through the hollow bore.

As shown in the cross section of FIG. 2, the mouthpiece portion 35 providing the open base area that serves as a mouthpiece for a consumer with an improved mouth feeling for the consumer. The hollow section 40 disposed between the smoking body 10 and the filter portion 30 is made of a spirally wound laminate of a cardboard sheet 42, a barrier layer 51 and a carrier layer 52.

Figure 3:
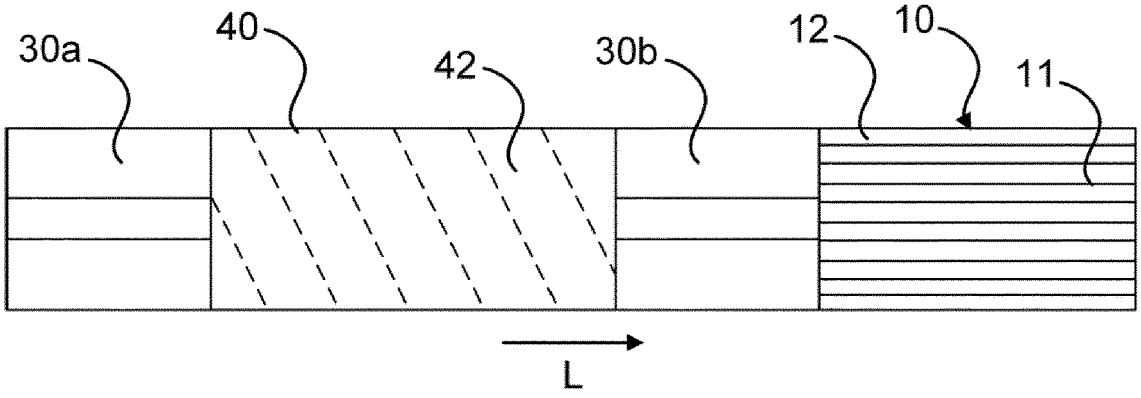
FIG. 3 illustrates a schematic cross section of a filter element of an elongated smoking article according to a second embodiment.

The filter cigarette 100 as shown in FIG. 3 differs from that of FIG. 2 in that a hollow section 40 is disposed between two filter portions 30*a*, 30*b*, wherein the filter portion 30*a* provides the mouthpiece portion for a consumer and might comprise more triacetin than filter portion 30*b*. However, also the hollow section 40 in FIG. 3 is made of a spirally wound laminate of a cardboard sheet 42, a barrier layer 51 and a carrier layer 52.

Figure 4:
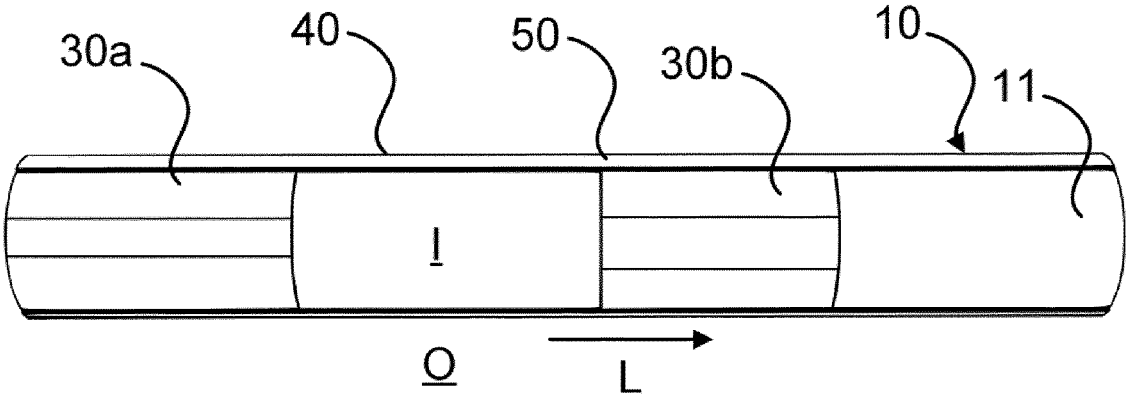
FIG. 4 illustrates a schematic cross section of a filter element of an elongated smoking article according to a third embodiment.

The filter cigarette 100 as shown in FIG. 4 shows a further particularly preferred embodiment of the invention. Therein, the filter cigarette 100 has a diameter of 7.2 mm and an overall length of 48 mm. Further, the cylindrical smoking body 10 is again positioned at the tip of the cigarette 100 in longitudinal direction L and has a length of 12 mm and is formed of slit and gathered cast leaf tobacco. Adjacent to this tobacco portion 10, a filter element 30*b* is disposed that is formed as a hollow bore filter with a length of 10 mm and a central bore having a diameter of 3.5 mm. Adjacent to the filter element 30*b*, the hollow cardboard tube 40 with an overall length of 14 mm and the properties as described above is disposed. Adjacent to the cardboard tube 40, at the other terminal end of the filter cigarette 100, another filter element 30*a* is disposed, which is also formed as hollow bore filter with a total length of 12 mm and a central bore having a diameter of 2 mm. In a preferred embodiment, the hollow bore of filter element 30*a* is faced with an inner paper liner impregnated with another flavoring and/or being colored for distinguishing a certain kind (e.g., flavor) of the filter cigarette 100. Alternatively, this hollow bore is filled with a mono-acetate filter or the like. In FIG. 4, further the inside (interior) of the hollow tube 40 is marked with I and the outside (exterior) of the hollow tube 40 is marked with O.

Figure 5:
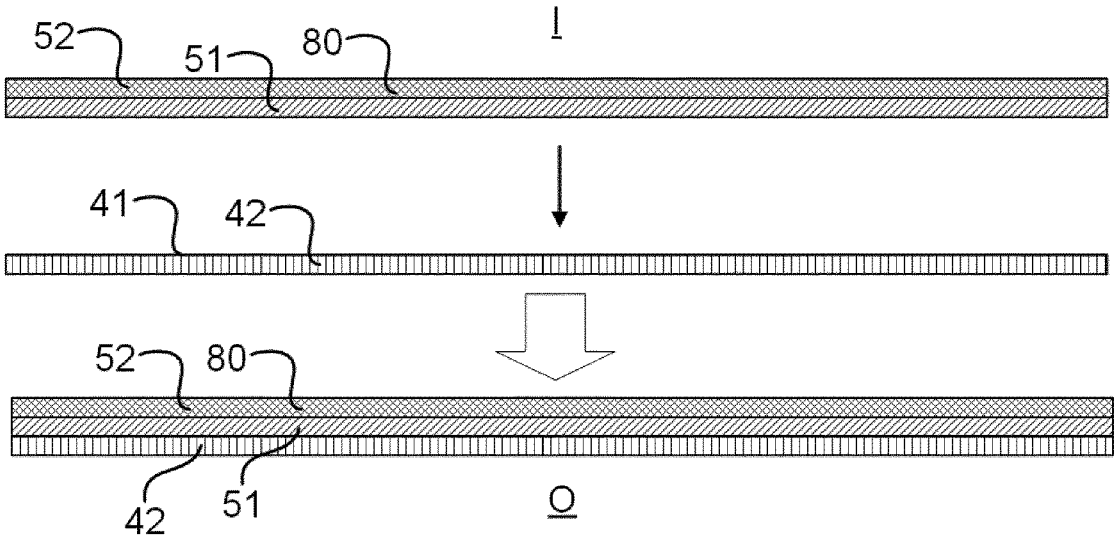
FIG. 5 schematically illustrates the manufacturing of a hollow section according to an embodiment.

A cross section of a laminate that is used for the hollow sections 40 of FIGS. 2 and 3 and that can be also used for the hollow section of FIG. 4 is shown in FIG. 5. As shown in the upper part of FIG. 5, a cardboard sheet 42 is provided with a shape that is suitable for forming a hollow cylinder by spirally winding the cardboard sheet 42. A laminate of a barrier layer 51 and a carrier layer 52 is disposed on an inner surface 41 of the cardboard sheet 42, e.g. via an adhesive layer (not shown). The laminate of the barrier layer 51 and the carrier layer 52 is an aluminum-paper-laminate, APL, and the barrier layer is thus an aluminum layer 51 and the carrier layer is thus a paper layer 52. After adhering the APL to the inner surface 41 of the cardboard sheet 42 the resulting laminate is spirally wound such that it partially overlaps with itself and is adhered to itself in the overlapping parts. Also in FIG. 5, the inside of the hollow tube 40 (to be formed) is marked with I and the outside is marked with an O.

Hence, the hollow section 40 is formed as a hollow cylinder from spirally wound cardboard sheet 42 with the APL 51, 52 disposed on an inner surface thereof and the carrier layer 52 facing the bore of the hollow section 40. Although in this example, the carrier layer 52 is paper it might also be at least partially formed of a weave, mesh, paper, and/or bibulous material. Preferably, the carrier layer 52 may also comprise a fibrous material, such as a cellulosic material, e.g. a lignocellulosic material. Exemplary cellulosic materials include flax fibers, hardwood pulp, softwood pulp, hemp fibers, esparto fibers, kenaf fibers, jute fibers and sisal fibers. Mixtures of two or more types of cellulosic materials can also be employed.

If the user thus draws an aerosol emitted by the heated smoking body 10 through the filter element 20, the aerosol comes into contact with the carrier layer 52 and heats up a volatile additive 80 that is contained in the fibrous carrier layer 52 (see also FIG. 5). Then, the volatile additive 80 evaporates and is added to the stream of drawn aerosol, where it may condense before it is inhaled by the consumer. The additive 80 can thus be used to provide a desired substance to a user, such as e.g. nicotine and/or a flavoring. At the same time, evaporation of the volatile additive 80 before usage of the elongated smoking article 100 by heating of the tobacco material 11 is advantageously prevented as a heat transfer from outside the elongated smoking article 100 is at least partially prevented by the cardboard sheet 42, the barrier layer 51 and/or the carrier layer 52. Further, the barrier layer 51 prevents the volatile additive 80 to diffuse through the cardboard sheet 42 and/or into wrapping paper 50. Hence, an unpleasant appearance of the elongated smoking article 100, e.g., with stained wrapping paper 50 can be advantageously prevented using the easy to manufacture filter element 20 comprising the hollow section 40 according to the invention.

REFERENCE SIGNS

10 cylindrical smoking body
11 heatable tobacco material
12 heat reflecting layer
20 filter element
30 filter portion
35 mouthpiece portion
40 hollow section
41 inner surface
42 cardboard sheet material
50 tipping paper
51 barrier layer
52 carrier layer
80 volatile additive
100 elongated smoking article
I inside (interior) of hollow tube
O outside (exterior) of hollow tube
L longitudinal direction

The invention claimed is:

1. Elongated smoking article (100) extending in a longitudinal direction (L), comprising:

a cylindrical smoking body (10) with a heatable tobacco material (11);

a cylindrical filter element (20) aligned with the smoking body (10) in the longitudinal direction (L) and having at least one filter portion (30) and at least one hollow section (40); and at least one paper (50) circumscribing the smoking body (10) and the filter element (20) for attaching the smoking body (10) and the filter element (20);

wherein the at least one hollow section (40) is disposed between the smoking body (10) and at least one of the at least one filter portion (30);

wherein there is no space between the filter portion (30) and the hollow section (40);

wherein the at least one filter portion (30) comprises a material configured to reduce unwanted substances from an aerosol drawn through the filter element (20) from the heated smoking body (10), wherein at least one hollow section (40) has a barrier layer (51) disposed on its inner surface (41) and a carrier layer (52) disposed on the barrier layer (51), and wherein the carrier layer (52) contains a volatile additive (80) and the barrier layer (51) prevents migration of the volatile additive (80) to an exterior of the hollow section (40).

2. Elongated smoking article (100) according to claim 1, wherein the volatile additive (80) is configured to release, upon interaction with the aerosol drawn through the filter element (20), at least one substance into the aerosol.

3. Elongated smoking article (100) according to claim 1, wherein the volatile additive (80) comprises a flavoring.

4. Elongated smoking article (100) according to claim 1, wherein the at least one hollow section (40) comprises a hollow cylinder spirally wound from a sheet material (42).

5. Elongated smoking article (100) according to claim 4, wherein the sheet material is cardboard (42).

6. Elongated smoking article according to claim 4, wherein the barrier layer (51) and the carrier layer (52) are attached to the unwound sheet material (42).

7. Elongated smoking articles (100) according to claim 1, wherein the barrier layer (51) and the carrier layer (52) are formed as a laminate.

8. Elongated smoking articles (100) according to claim 1, wherein the barrier layer (52) comprises a metal or a plastic material and/or wherein the carrier layer (51) comprises a fibrous material.

9. Elongated smoking article (100) according to claim 1, wherein the barrier layer (51) is an aluminum layer and the carrier layer (52) is a paper layer.

10. Elongated smoking articles (100) according to claim 1, wherein the heatable tobacco material (11) is configured to emit a tobacco-flavored aerosol when being heated to a temperature below a combustion point of the heatable tobacco material (11).

11. Elongated smoking articles (100) according to claim 1, wherein the cylindrical smoking body (10) comprises a heat reflecting layer (12) circumscribing the heatable tobacco material (11).

12. Elongated smoking articles (100) according to claim 1, wherein the at least one filter portion (30) comprises a cellulose acetate and triacetin.

13. Elongated smoking articles (100) according to claim 1, wherein the barrier layer (51) is configured to prevent the volatile additive (80) to pass through the hollow section (40) and/or into the tipping paper (30).

14. Elongated smoking article (100) according to claim 1, wherein the volatile additive (80) is disposed in the carrier layer (52) by applying a solution of the volatile additive to the carrier layer (52).

* * * * *